United States Patent [19]

Hanloser et al.

[11] 4,203,285

[45] May 20, 1980

[54] PARTIAL SWIRL AUGMENTOR FOR A TURBOFAN ENGINE

[75] Inventors: Kurt J. Hanloser, North Palm Beach; Raymond J. Bruchez, Lake Park; James T. Gill, Jr., North Palm Beach, all of Fla.

[73] Assignee: The United States of America as represented by the Secretary of the Air Force, Washington, D.C.

[21] Appl. No.: 875,664

[22] Filed: Feb. 6, 1978

[51] Int. Cl.[2] ..... F02K 3/10

[52] U.S. Cl. ..... 60/261; 60/749

[58] Field of Search ..... 60/261, 262, 39.72 R; 239/265.17, 127.3

[56] References Cited

U.S. PATENT DOCUMENTS

| | | | |
|---|---|---|---|
| 3,485,045 | 12/1969 | Riecke | 60/39.72 R |
| 3,540,216 | 11/1970 | Quillevere et al. | 60/39.72 R |
| 3,675,419 | 7/1972 | Lewis | 60/39.72 R |
| 3,765,178 | 10/1973 | Hufnagel et al. | 60/261 |
| 3,930,370 | 1/1976 | Markowski et al. | 60/261 |
| 3,931,707 | 1/1976 | Vdoviak | 60/39.72 R |

*Primary Examiner*—Douglas Hart

*Attorney, Agent, or Firm*—Joseph E. Rusz; Jacob N. Erlich

[57] ABSTRACT

A partial swirl augmentor for a turbofan engine having an annular duct for directing hot gases into the augmentor combustion chamber. Located within the combustion chamber is a piloted vee-gutter flameholder system which has a circumferential pilot located at the outer edge of the swirling hot turbine exhaust gas stream. As a result thereof, the partial swirl augmentor can attain state-of-the art engine after burning thrust levels with an increased altitude blow-out limit.

5 Claims, 2 Drawing Figures

PARTIAL SWIRL AUGMENTOR FOR A TURBOFAN ENGINE

STATEMENT OF GOVERNMENT INTEREST

The invention described herein may be manufactured and used by or for the Government for governmental purposes without the payment of any royalty thereon.

BACKGROUND OF THE INVENTION

This invention relates generally to afterburners, and, more particularly to a partial swirl augmentor for a turbofan engine.

It is well known in the aircraft gas turbine art to provide thrust augmentation by burning additional fuel in an afterburner located downstream of the engine turbine. The afterburner generally includes a means for dispersing a main flow of fuel together with a flameholder to which the flame may attach. The flameholder reduces locally the velocity of the gas stream in order to sustain the flame which would otherwise blow out. One well known type of flameholder comprises two concentric flame rings arranged to diverge from each other in a downstream direction. The main flow of fuel is dispersed in a manner that allows fuel droplets to impinge upon the outside diverging surfaces of the flameholder wherein the afterburning flame attaches to the trailing edges of the flame rings.

In order to provide for positive and uniform lightoff of the afterburner during all modes of flight operation, pilot fuel may be introduced and sparked to ignite by means of a point source igniter. The pilot flame in turn operates to ignite the main fuel droplets. It is well known to introduce the pilot fuel to the afterburner by means of discrete jets situated around the flameholder. The pilot fuel jets are generally located intermediate the flame rings such that each pilot jet receives gas flow from the turbine exhaust through an individual inlet opening in the leading edge of the flameholder.

Generally state-of-the-art afterburners leave much to be desired since they do not permit swirling airflow in the afterburner because high velocities will exist over the flameholder causing both blow-out and decreased engine thrust due to high flameholder pressure loss.

SUMMARY OF THE INVENTION

The partial swirl augmentor of the instant invention overcomes the problems set forth hereinabove by combining the state-of-the-art bluff body flame spreading techniques with "g" field flame stabilization created by swirling a portion of the afterburner gas flow inboard of a burning perimeter flame stabilizer. As a result thereof this invention can attain the afterburning thrust levels of the past and in addition develop an increased altitude blow-out limit.

A conventional gas turbine engine of the type having a compressor, combustor, and turbine in serial flow relation is provided with thrust augmentation by an augmentor. The augmentor generally includes a flameholder having an inner flame ring, and an outer flame ring spaced radially outward and concentric to the inner flame ring. Means are further included for introducing a main flow of fuel outside the flame rings together with means for attaching the flame rings to the engine casing.

The partial swirl turbofan augmentor of this invention is made up of a piloted vee-gutter flameholder system which has a circumferential vee-gutter pilot located at the outer edge of the swirling hot turbine exhaust gas stream. The remaining portion of the flameholder assembly is composed of radial vee-gutters, which are attached to the circumferential pilot so that they penetrate only into the cold fan stream airflow.

Turbine exhaust gases leave the last turbine rotor of a gas turbine engine with residual swirl. The swirling gases are directed into a combustion chamber through an annular duct. Cold fan air is directed into the augmentor combustion chamber through another annular duct. A portion of the fan stream is passed between a liner and combustion chamber duct for cooling purposes. Fuel is injected into the augmentor airflow in annular regions by a plurality of sprayrings.

Ignition of the augmentor of this invention is accomplished by locating a sparkplug in a sheltered region of the circumferential vee-gutter pilot. The flame front is stabilized by bluff-body aerodynamics of conventional augmentors at the outer edge of the core stream and in the fan stream. The core stream flame front, inboard of the circumferential pilot is stabilized by the "g" (centrifugal force gravity) field generated by residual swirl remaining in the turbine exhaust gases entering the augmentor. The "g" field causes inboard migration of hot gases discharging from the pilot due to the buoyancy effect of the induced "g" field.

The partial swirl augmentor of this invention teaches tailoring a portion of the gas flow to swirl in a discrete region of the augmentor. The gas flow must swirl inboard of a high temperature gas source such as that produced by combustion downstream of prior art flame holding systems. Flameholder blockage required in afterburners of the past to achieve efficiency by flame spreading is reduced because the induced "g" field propagates the flame. The reduced flameholder blockage results in lower velocities over the flameholder, increasing altitude blow-out limit.

It is therefore an object of this invention to provide a partial swirl augmentor for a turbofan engine which eliminates a vane cascade or exit guide vanes to straighten turbine discharge airflow entering the augmentor thereby reducing engine weight and cost.

It is a further object of this invention to provide a partial swirl augmentor for a turbofan engine which eliminates the requirement of flameholders in the turbine exhaust gas flow for flame stabilization thereby increasing the durability of the augmentor.

It is still a further object of this invention to provide a partial swirl augmentor for a turbofan engine which increases altitudes at which successful augmentor throttle bursts can be performed because lower air/fuel mixture velocities exist at the flameholder lip with a small blockage flameholder and because increased flame spreading rates exist in the centrifugal flow field.

It is another object of this invention to provide a partial swirl augmentor for a turbofan engine whose basic configuration can be readily optimized for unaugmented thrust by varying both swirl angle and core stream airflow permitted to swirl at the augmentor inlet.

It is still another object of this invention to provide a partial swirl augmentor for a turbofan engine which is economical to produce and which utilizes conventional, currently available components that lend themselves to standard mass producing manufacturing techniques.

For a better understanding of the present invention, together with other and further objects thereof, reference is made to the following description taken in connection with the accompanying drawing and its scope will be pointed out in the appended claims.

DETAILED DESCRIPTION OF THE DRAWING

Figure 1:
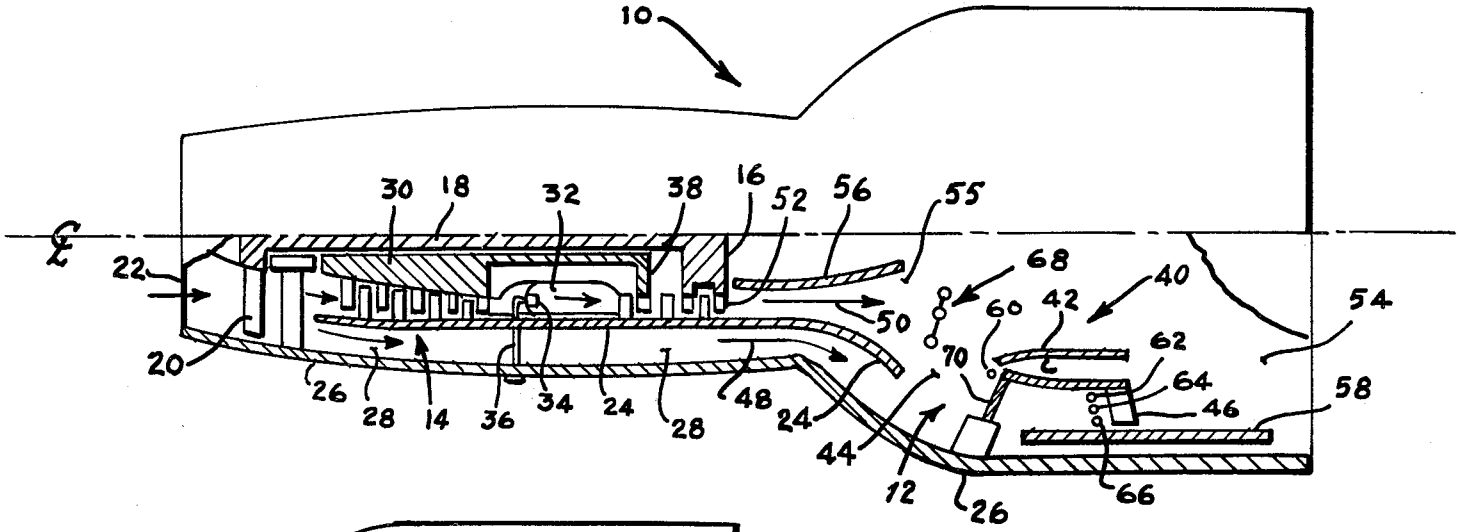
Figure 2:
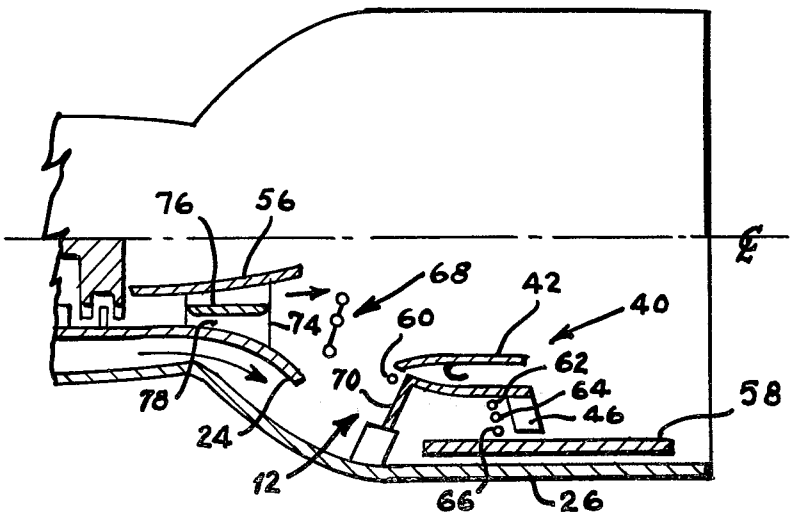

FIG. 1 is a side elevational view of the partial swirl augmentor of this invention in combination with a turbofan engine and shown partially fragmented and in cross-section; and FIG. 2 is a side elevational view of the modified partial swirl augmentor of this invention shown partly in cross-section.

DETAILED DESCRIPTION OF THE PREFERRED EMBODIMENTS

Reference is now made to FIG. 1 or the drawing which best illustrates a turbofan engine 10 which incorporates therein the partial swirl augmentor 12 of this invention. Turbofan 10 is made up of a core engine 14 which generates a hot gas stream for driving a fan turbine 16. The turbine 16 is connected to and drives the rotor 18 of a fan 20 disposed at the inlet end 22 of the engine. The core engine 14 and the fan turbine 16 are disposed within an outer fairing 24. An elongated cowl, or outer casing 26 defines the engine inlet indicated at 22 and in combination with fairing 24, defines a duct 28 concentric of core engine 14.

In operation, fan 20 pressurizes an air stream, the outer portion of which passes along the duct 28 and the inner portion of which enters the core engine 14. In the core engine 14, the air stream is further compressed by a core engine compressor 30 to provide a highly pressurized air stream for supporting combustion of fuel in a combustor 32. Fuel to combustor 32 is provided by fuel injection means 34 which receives a flow of presurized fuel through conduit 36 from a source of presurized fuel (not shown). The hot gas stream thus generated drives a high pressure, core engine turbine 38 which is connected to the rotor of the compressor 30.

The partial swirl augmentor 12 of this invention is situated at the aft end of turbofan 10 adjacent fan turbine 16 and provides additional thrust augmentation. Augmentor 12 is made up of a conventional piloted vee-gutter flameholder system 40 which has a circumferential vee-gutter pilot 42 located at the outer edge 44 of the swirling hot turbine exhaust gas stream, representative exhaust gases being at temperatures above 1000° F. In this invention it is essential that the vee-gutter pilot 42 be so positioned with respect to the swirling exhaust gas, and thereby also eliminates durability problems and maintenance inherent with flameholders in the hot gas stream. The remaining portion of flameholder system 40 is composed of radial vee-gutters 46 which are attached to pilot 42 in such a position that they penetrate only into the cold fan stream airflow 48, representative airflow being at temperatures of between 200° F.-500° F.

During turbofan operation, turbine exhaust gases 50 leave the last turbine rotor 52 with residual swirl of typically 20° to 35°. The swirling gases are directed into the combustion chamber 54 of augmentor 12 through an annular duct 55 formed between an inner fairing 56 and outer fairing 24. The cold fan air 42 is directed into the combustion chamber 54 of augmentor 12 through annular duct 28 formed between outer fairing 24 and outer casing 26. A portion of the cold fan stream 48 is passed between a liner 58 and outer casing 26. A portion of the cold fan stream 48 is passed between a liner 58 and outer casing 26 for cooling purposes.

Fuel is injected into the air flow of augmentor 12 in annular regions by a plurality of spray rings 60, 62, 64, 66 and 68. Spray ring 60 is situated adjacent vee-gutter pilot 42 while the plurality of spray rings 62, 64 and 66 are disposed radially adjacent radial vee-gutters 46. Situated within the flow field of swirling hot gases 50 are a plurality of fuel injector spray rings 68.

Initial fuel is injected into augmentor 12 through spray ring 60 as augmentor ignition is accomplished by locating a conventional spark ignition system 70 adjacent thereto in a sheltered region of circumferential vee-gutter pilot 40. Upon ignition, fuel enters augmentor 12 in the following order through sprayings 62, 64, 68 and 66, respectively, with the hot gases themselves providing the ignition system for the rest of augmentor 12.

The flame front is stabilized by bluff-body aerodynamics of conventional augmentors at the outer edge of the core stream and in the fan stream. The core stream flame front, inboard of circumferential pilot 40 is stabilized by the "g" (centrifugal force gravity) field generated by residual swirl remaining in the turbine exhaust gases entering augmentor 12. The "g" field causes inboard migration of hot gases discharging from pilot 40 due to the buoyancy effect of the induced "g" field. In the centrifugal force field, flamespreading rates increase by a factor of 3 over conventional flameholders.

Reference is now made to FIG. 2 of the drawing which best illustrates the modified partial swirl augmentor 72 of this invention. With respect to further reference to partial swirl augmentor 72 and FIG. 2 of the drawing and for purposes of clarity of understanding of the invention, like numerals will represent identical elements in both FIG. 1 and FIG. 2 of the drawing.

Augmentor 72 of this invention modifies partial swirl augmentor 12 by incorporating a conventional swirl vane assembly 74 in the annular duct 50 formed between inner fairing 56 and outer fairing 24. A conventional splitter 76 and a conventional straightening vane 78 are also placed in the turbine exhaust duct 50. The swirl vane assembly 74 puts 15° to 20° of swirl into the augmentor inlet airflow which passes through it while splitter 76 and straightening vane 78 limit the amount of turbine exhaust airflow permitted to swirl at the augmentor inlet. Such an arrangement of the instant invention provides the flame stabilization advantages for increased transient augmentor altitude capability, but minimizes performance losses of swirling flow discharging through the engine exhaust nozzle.

Although this invention has been described with reference to a particular set of embodiments, it will be understood to those skilled in the art that this invention is also capable of further and other embodiments within the spirit and scope of the appended claims.

We claim:

1. In a turbofan engine having a casing enveloping a compressor, combustor and turbine in axial flow relationship, the improvement therein being in the form of a partial swirl augmentor for providing an additional thrust to said turbofan engine positioned downstream of said turbine, said partial swirl augmentor consisting of a combustion chamber, an inner fairing and an outer fairing, an annular duct formed between said inner fairing and said outer fairing for directing swirling hot gases emanating from said turbine into said combustion chamber, cooler gases being directed between said outer fairing and said casing into said combustion chamber for mixing with said swirling hot gases, means located within said combustion chamber for injecting fuel into said combustion chamber in a preselected manner, a flameholder system, said flameholder system consisting of a vee-gutter pilot and a plurality of radial vee-gutters attached to said pilot, said pilot being located directly adjacent the outer edge of said swirling hot gases and situated substantially in line with said outer fairing and substantially radially disposed from the central longitudinal axis of said duct, said vee-gutters penetrating into said cooler gas and a spark ignition system located adjacent said vee-gutter pilot.

2. In a turbofan as defined in claim 1 wherein said fuel injecting means consists of a plurality of sprayrings, at least one of said sprayrings being centrally disposed adjacent said annular duct.

3. In a turbofan engine as defined in claim 2 wherein the remainder of said sprayrings are located adjacent said pilot and said vee-gutters, respectively.

4. In a turbofan engine as defined in claim 1 wherein said augmentor further comprises means located in said annular duct for putting 15°–20° of swirl into said inlet gas flow passing therethrough.

5. In a turbofan engine as defined in claim 4 wherein said augmentor further consists of means located in said annular duct for limiting the amount of turbine exhaust permitted to swirl.

* * * * *